US006609351B2

(12) United States Patent
Shibazaki et al.

(10) Patent No.: US 6,609,351 B2
(45) Date of Patent: Aug. 26, 2003

(54) BAND FEED LENGTH ADJUSTING DEVICE IN PACKING MACHINE

(75) Inventors: Tokio Shibazaki, Kawasaki (JP); Tadashi Meguro, Kawasaki (JP); Yosikatsu Aizawa, Kawasaki (JP); Kenichi Enda, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 09/908,399

(22) Filed: Jul. 18, 2001

(65) Prior Publication Data

US 2002/0007615 A1 Jan. 24, 2002

(30) Foreign Application Priority Data

Jul. 19, 2000 (JP) ..... 2000-218777

(51) Int. Cl.[7] ..... B65B 57/02
(52) U.S. Cl. ..... 53/64; 53/389.4
(58) Field of Search ..... 53/64, 389.4, 589

(56) References Cited

U.S. PATENT DOCUMENTS 3,045,884 A * 7/1962 Buhrendorff ..... 225/16
3,946,921 A * 3/1976 Noguchi ..... 100/26
4,271,655 A * 6/1981 Nagayoshi ..... 53/201
4,559,767 A * 12/1985 Takami ..... 100/32
4,691,498 A * 9/1987 Stamm ..... 100/32
5,236,329 A * 8/1993 Sylvester ..... 100/26
5,379,576 A * 1/1995 Koyama ..... 100/26
5,442,899 A * 8/1995 Shibazaki et al. ..... 53/389.4
5,809,873 A * 9/1998 Chak et al. ..... 100/26

FOREIGN PATENT DOCUMENTS

GB 2019040 * 10/1979

* cited by examiner

*Primary Examiner*—Scott A. Smith
*Assistant Examiner*—Nathaniel Chukwurah
(74) *Attorney, Agent, or Firm*—Webb Ziesenheim Logsdon Orkin & Hanson, P.C.

(57) ABSTRACT

A band feed length adjusting device in a packing machine which can newly input, to a control section, a length obtained by manually leading out a band to adjust the feed length of the band and can subsequently feed the band having a correct length in the case in which the size of an object to be packed is changed to be larger.

1 Claim, 5 Drawing Sheets

PRIOR ART

PRIOR ART

BAND FEED LENGTH ADJUSTING DEVICE IN PACKING MACHINE

BACKGROUND OF THE INVENTION

1. Field of the Invention

The present invention relates to a band feed length adjusting device in a packing machine, and more particularly to a band feed length adjusting device in a semi-automatic packing machine which can feed a band having a proper length at a next banding operation if a fed band is short.

2. Description of the Related Art

For example, as shown in FIG. 4, a semi-automatic banding packing machine comprises a band reel 1 provided under a packing machine body 4. A band led from the band reel 1 is caused to pass through a suspension roller 2 and then through a roller 3 of a brake arm and is thereafter inserted in a hole 5 provided on the packing machine body 4. In this manner, a first band insertion is carried out.

In such a semi-automatic machine, the packing machine body 4 includes band feeding means A having a driving roller 7 and a touch roller 9 and band returning means B having a driving roller 8 and a touch roller 10 as shown in FIG. 5. In the semi-automatic machine comprising such a band feeding device, when one of the means is driven, the other means is stopped. Thus, the band can freely be moved between the rollers on the stop side.

In order to carry out banding, when a band feeding switch 14 is first turned on, the operation of the band feeding means A is started in response to an instruction signal sent from a controller so that a band having a predetermined length is pushed out toward the upper surface side of the packing machine body 4. Then, the tip of the band thus pushed out is wound upon the periphery of an object to be packed and is inserted into the packing machine body. Consequently, the tip of the band abuts on a limit switch provided on the band feeding device in the packing machine body so that operation of the band returning means B is started and the band is then returned in a reverse direction. Thus, the band is consecutively returned and tightened.

In addition to such a structure that permits the band to be fed by means of two roller pairs and then returned and tightened, a band feeding device is also known in which the band is fed and returned and tightened by means of one roller pair. For example, as shown in FIG. 6, a driving roller 11 is constructed to be reciprocally rotatable and a touch roller 12 abuts the roller 11 so that the band can be selectively fed and tightened by means of a roller pair.

In a conventional semi-automatic banding machine, the feed length of the band by the band feeding means A is typically adjusted by controlling by means of a timer a time required for rotating the driving roller 7.

However, an object to be packed has various sizes. Accordingly, if an object to be packed having a certain size is banded and a next object to be packed having a larger size is to be then banded, the band having a current feed length cannot be wound upon the larger object to be packed. In that case, conventionally, the band shortage has been adjusted by manually pulling out the tip of the band without changing the set time of the timer.

However, even if the length of the band is thus adjusted, a countermeasure is taken only once. Therefore, also in the case in which the banding is to be subsequently carried out, only the band having a current small length is fed.

Accordingly, the length of the band is still insufficient. Therefore, the insufficient part should be led out again.

SUMMARY OF THE INVENTION

In consideration of the above-mentioned circumstances, it is an object of the present invention to provide a band feed length adjusting device in a packing machine which can newly input, to a control section, a value obtained by manually leading out a band to adjust the feed length of the band at a first work and can subsequently feed the band having a correct length in the case in which the size of an object to be packed is changed to be larger.

In order to achieve the above-mentioned object, the present invention provides a band feed length adjusting device in a packing machine in which

- a plurality of detecting portions are provided at regular intervals on a side surface of a touch roller which is opposed to a normal rotating roller or a reverse rotating roller and serves to selectively abut on one of the two rollers, thereby constituting band feeding means or band reverse rotating means, and furthermore,
- a sensor for detecting the detecting portions is provided to face an outer periphery of the touch roller,
- wherein when an amount of the band led from a band reel through a driving operation of the band feeding means for winding onto an object to be packed is insufficient, the band having a length corresponding to the shortage is led from the band reel through a manual operation and
- the detecting portions of the touch roller thus moved are detected by the sensor and a result of the detection is supplied to a control section, thereby automatically adjusting a band length required for subsequent band feeding.

According to the present invention having the above-mentioned structure, it is possible to measure the shortage of the length of the band led out by means of the sensor. Consequently, if the shortage of the length of the band is newly input to the control section, the band having a length correctly set can be subsequently fed.

As described above, in the band feed length adjusting device in the packing machine according to the present invention, the amount of the band to be led out is automatically calculated through the rotation of the touch roller and is added to the feed amount for the subsequent banding. Therefore, in the case in which the size of the object to be packed is changed to be larger, the band feed length can be adjusted automatically.

These objects as well as other objects, features and advantages of the present invention will become more apparent to those skilled in the art from the following description with reference to the accompanying drawings.

DETAILED DESCRIPTION OF THE INVENTION

An embodiment of the present invention will be described below with reference to the drawings.

Figure 1:
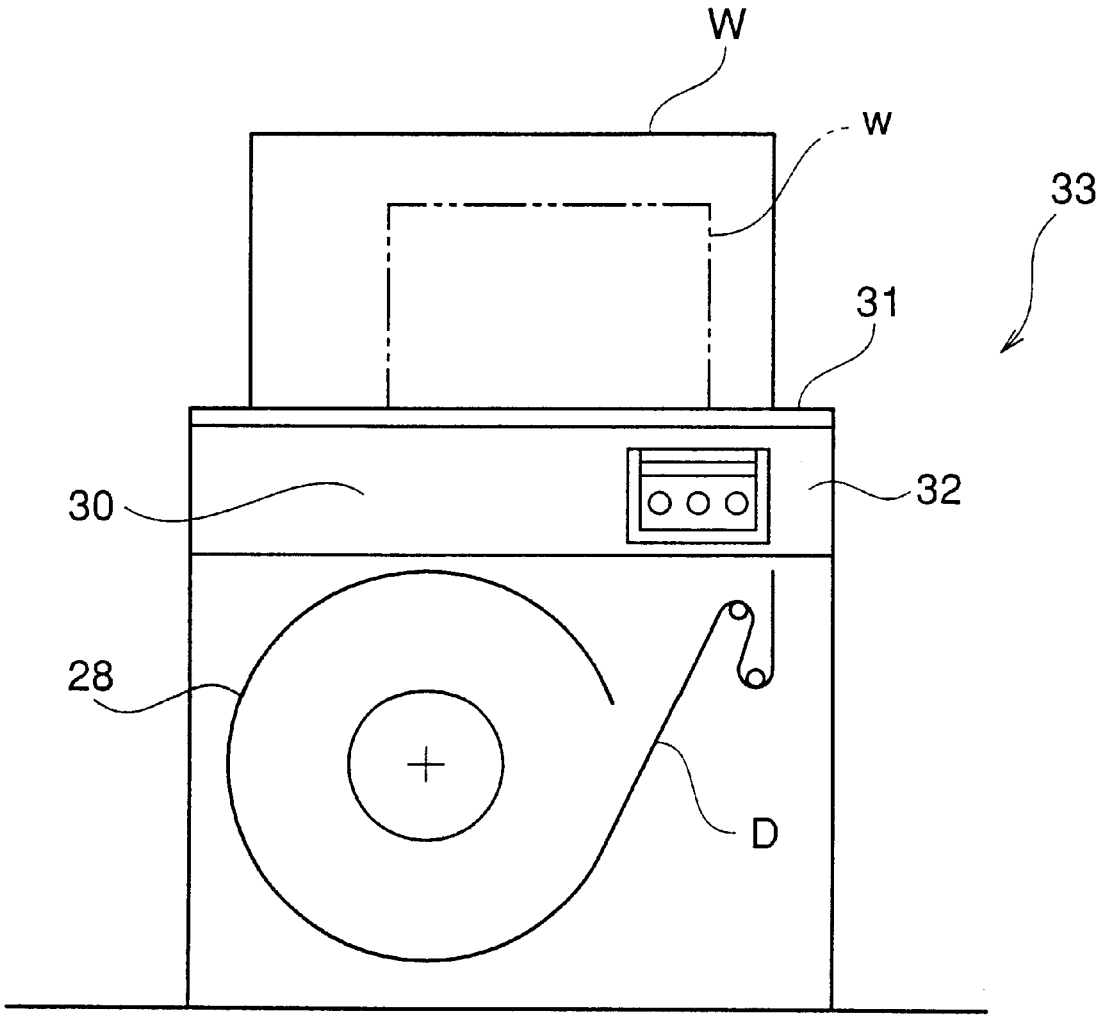
FIG. 1 is a schematic view showing a packing machine comprising a band feed length adjusting device according to an embodiment of the present invention.

FIG. 1 shows a semi-automatic packing machine 33 according to the embodiment of the present invention.

In the packing machine 33, a band reel 28 having a long band D wounded thereupon is accommodated in the lower space of a packing machine body 30.

A band feeding device 32 for feeding and returning a band is positioned on a lower surface of an upper surface table 31 on which a small object w to be packed, a large object W to be packed or the like is to be placed.

Figure 2:
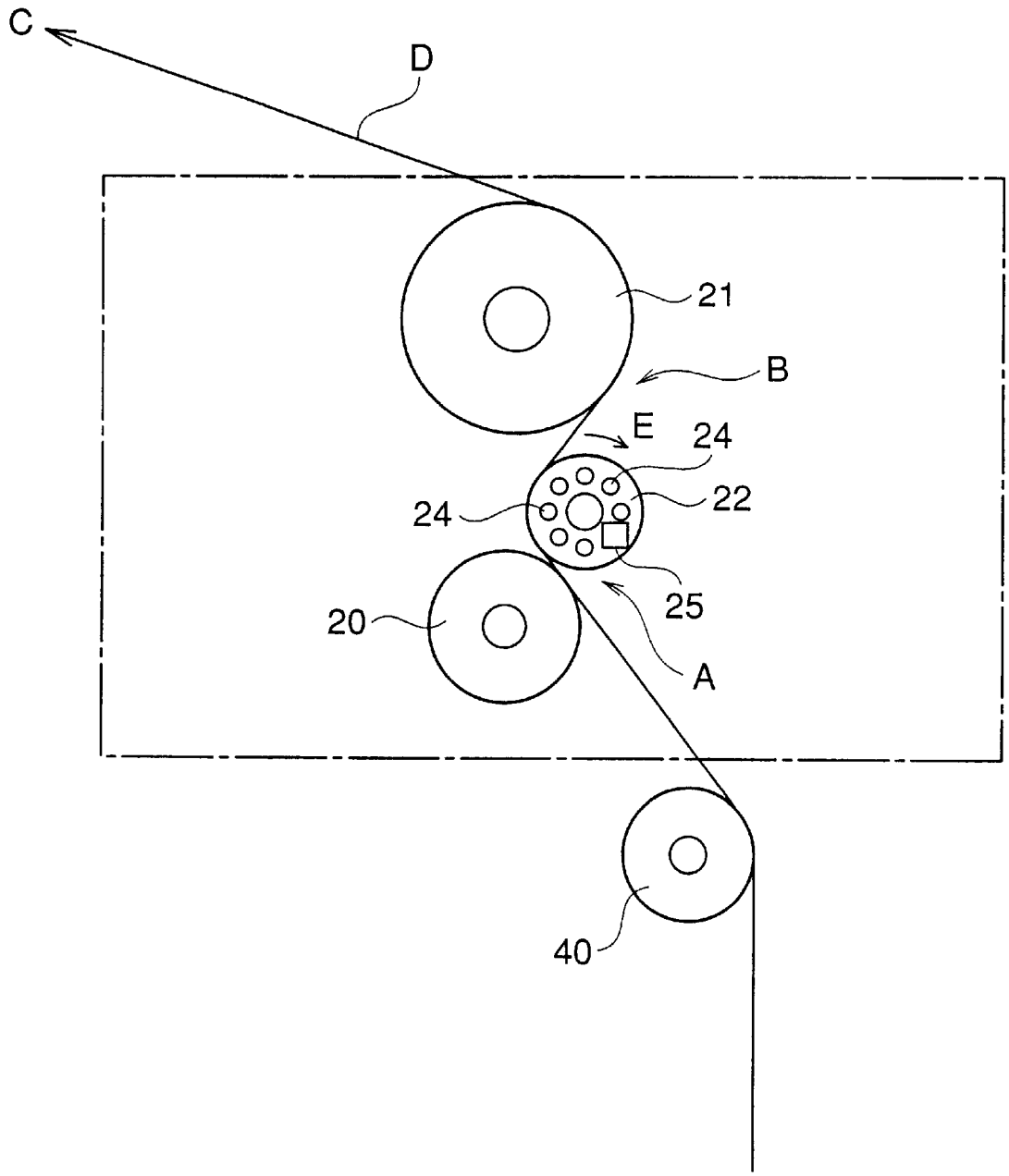
FIG. 2 is a sectional view showing a band feeding device provided in the packing machine.

The band feeding device 32 has a structure that includes a normal rotating roller 20 for feeding the band D to the side of the object to be packed and a reverse rotating roller 21 for returning the band D toward the guide roller 40 side at a predetermined interval. A touch roller 22 is opposed to the two rollers 20 and 21 as shown in FIG. 2. The touch roller 22 is movably provided to selectively abut on the peripheral surface of the normal rotating roller 20 or the reverse rotating roller 21 through position changing means which is not shown. Moreover, a clearance to permit free insertion of the band D therethrough is maintained between the roller 21 and the roller 22 or between the roller 22 and the roller 20. In addition, since the reverse rotating roller 21 is formed of metal, the band D is not wound upon the roller 21 to create a resistance even if it is pulled in a direction of an arrow C.

In the band feeding device 32 having such a structure, a band path is maintained between the rollers. Therefore, a low resistance is generated when the band D is to be pulled out in the direction of the arrow C. Moreover, the band D is wound upon the touch roller 22. Therefore, even if the band D is pulled in any direction, the touch roller 22 can be rotated.

On the other hand, a plurality of holes 24 is formed on the side surface of the touch roller 22 at regular intervals along an outer peripheral side surface as shown in FIG. 2. Furthermore, a sensor 25 for detecting the holes 24 is fixed to face the side surface of the touch roller 22.

Figure 3:
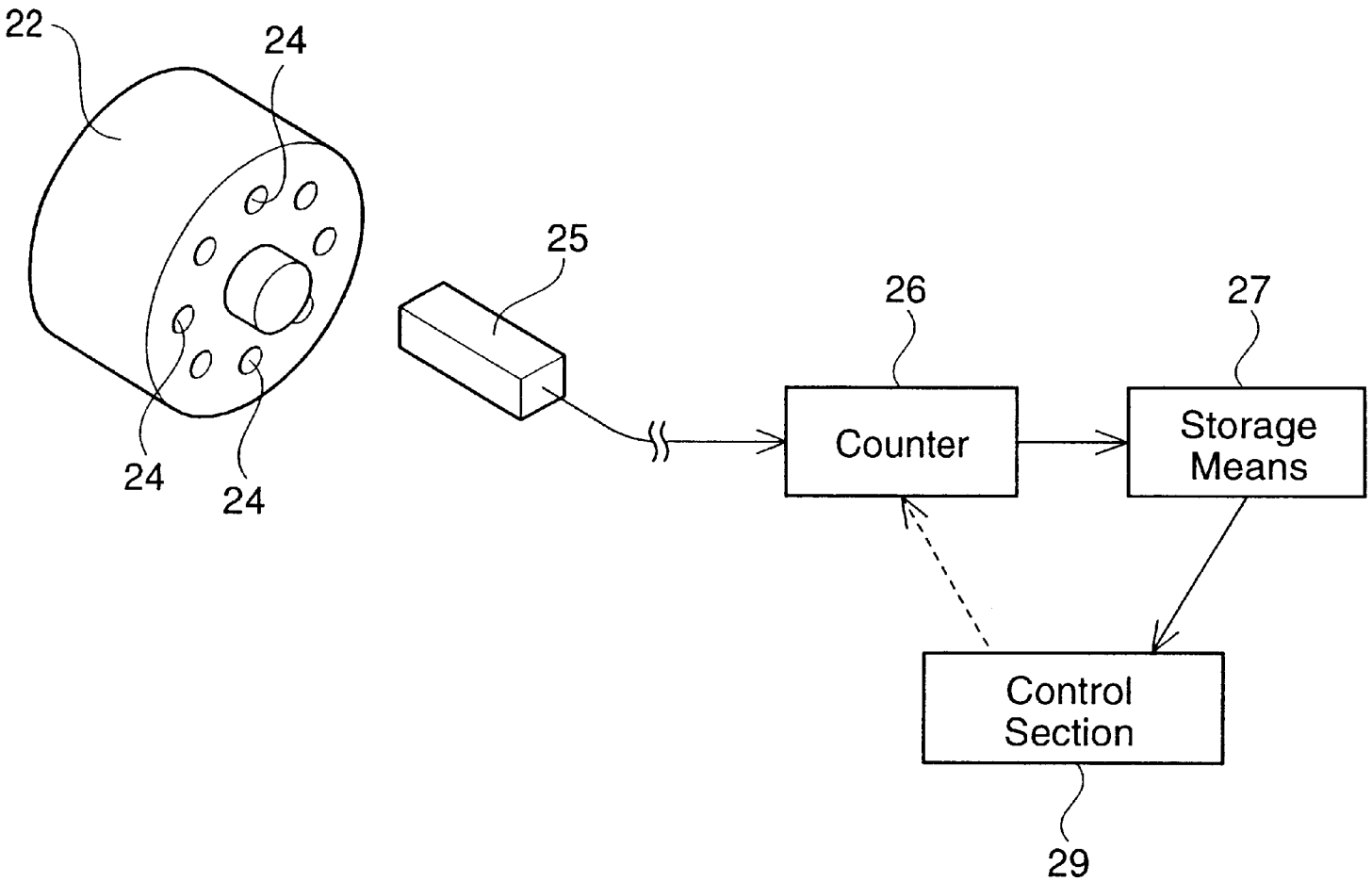
FIG. 3 is a schematic view showing a rotation detecting section provided in a touch roller of the band feeding device.
Figure 4:
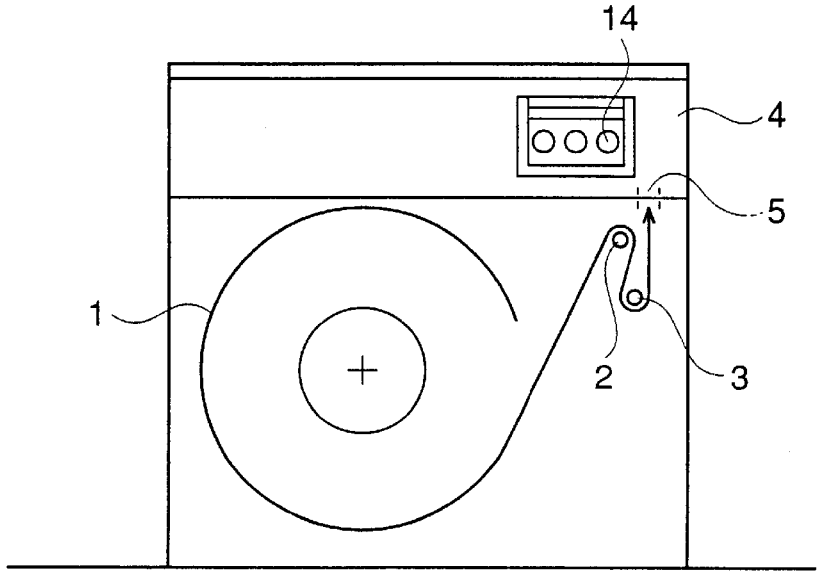
FIG. 4 is a schematic view showing a conventional packing machine.
Figure 5:
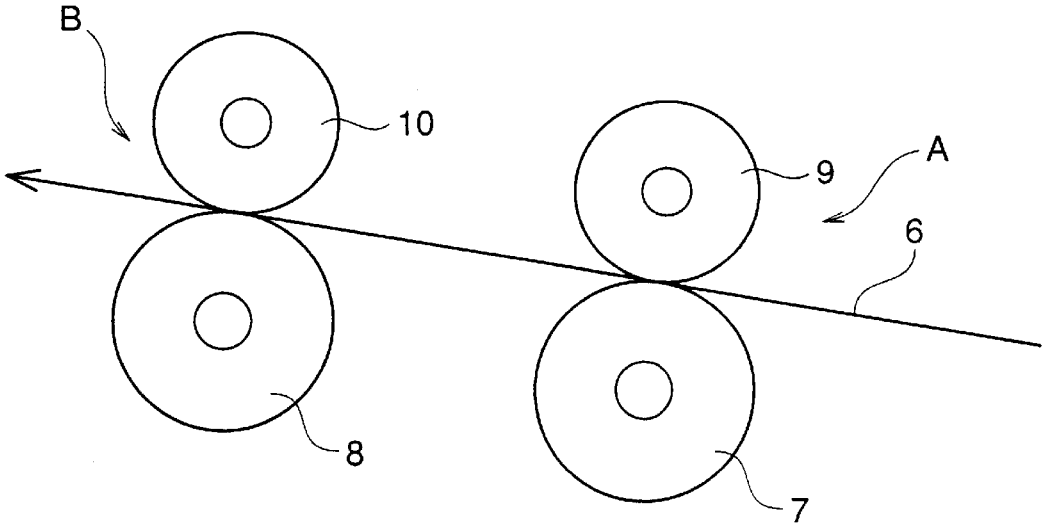
PRIOR ART Fig. 5
FIG. 5 is a front view showing a band feeding device provided in the conventional packing machine.
Figure 6:
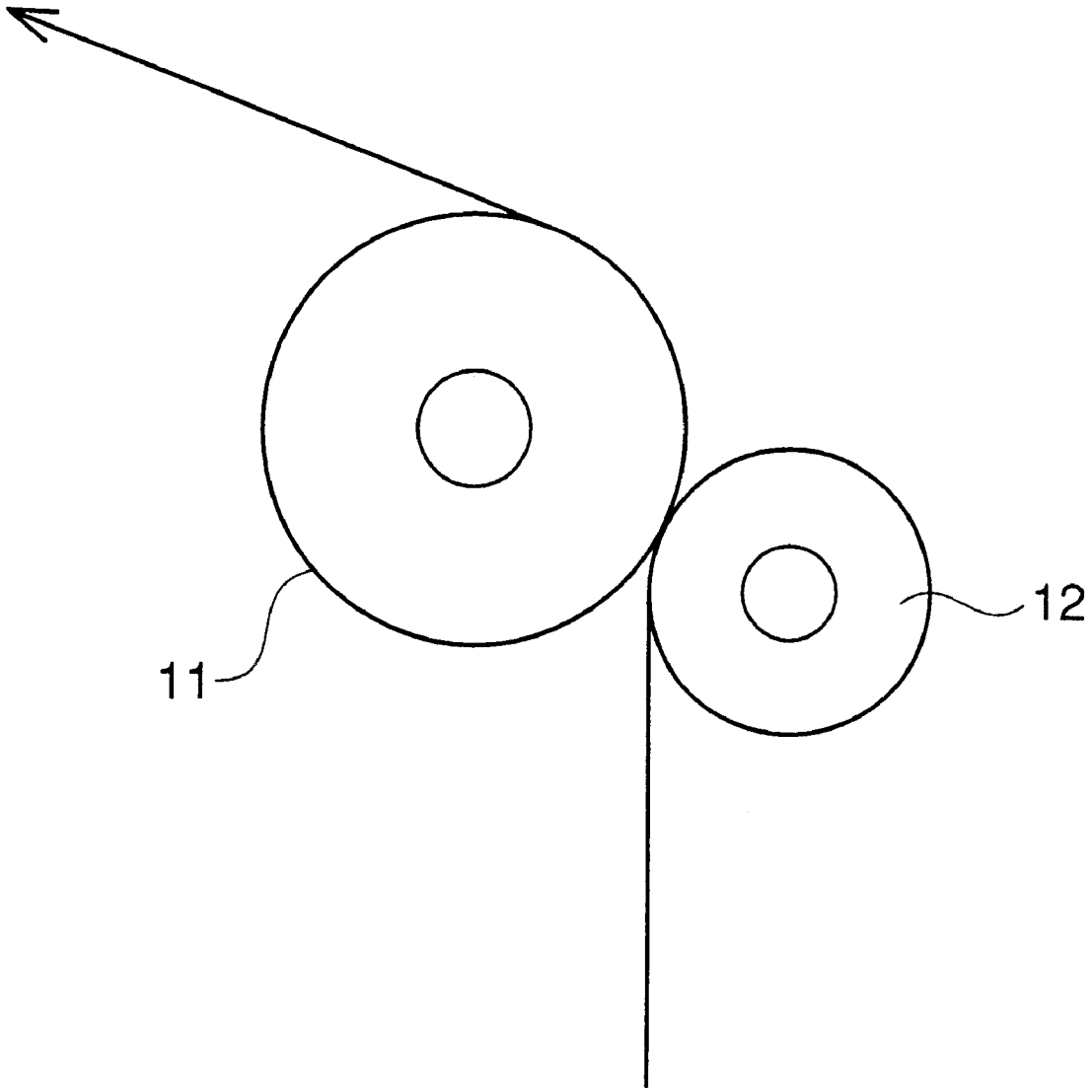
FIG. 6 is a front view showing another conventional band feeding device.

As shown in FIG. 3, the sensor 25 comprises an optical sensor, a magnetic sensor or the like. A movement distance coincident with the rotation of the touch roller 22 is detected by the sensor 25. More specifically, the holes 24 pass through the optical beam of sensor 25 so that the travel distance of the outer peripheral surface of the touch roller 22 is detected. The movement distance is equivalent to the amount of band feed. A detection signal is counted through a counter 26, and is stored in storage means 27 and is output to a control section 29.

In the semi-automatic packing machine 33 comprising the band feeding device 32 described above, for example, in the case in which the small object w to be packed is banded and the large object W to be packed is then banded, the feed amount of the band is set in the control section 29 such that the band having a small length is still fed.

As shown in a dotted chain line of FIG. 1, the object w to be packed which has a small size is provided on the upper surface table 31.

For the band feeding operation in this state, the touch roller 22 abuts on the peripheral surface of the normal rotating roller 20 in response to a signal sent from the control section 29 and thus constitutes band feeding means A together with the normal rotating roller 20. In other words, the touch roller 22 separates from the reverse rotating roller 21 and the band D can freely reciprocate therebetween.

The band feeding means A is driven by a pulse set number provided in the control section 29 and the band having a predetermined length is fed toward the object w to be packed. However, the band thus fed has such a length as to be simply wound upon the small object w to be packed. In order to correctly carry out the banding over the object W to be packed (shown in a solid line) having a greater width and height than smaller object w, it is preferable that the following operation should be performed.

First of all, a worker grips the tip of the band extended up to the middle by hand to lead out the band having such a length as to correspond to a shortage from the band reel 28. Consequently, the touch roller 22 is rotated in a direction of an arrow E in FIG. 2 corresponding to the length of the band D pulled in the direction of the arrow C. The amount of the rotation of the touch roller 22 in the direction of the arrow C is detected through the detection of the movement of the holes 24 by means of the sensor 25. A detection signal is counted by the counter 26, and is then stored in the storage means 27 and is sent to the control section 29. Thus, a new band feed length is set.

On the other hand, when the worker grips the tip of the band pulled out sufficiently by hand and inserts the tip of the band into the packing machine body 30, the tip of the band abuts on a limit switch so that the band is returned and tightened in response to the signal. Subsequently, the band having an automatically adjusted length is fed in the following manner.

More specifically, the band is fed through the driving operation of the normal rotating roller 20 of the band feeding means A and the touch roller 22 is rotated. At the same time, the rotation of the holes 24 is detected by the sensor 25 and a result of the detection is output to the counter 26. A number counted by the counter 26 is compared with a number stored in the storage means 27 through comparing means. When the numbers are equal to each other, the rotation of the normal rotating roller 20 is stopped in response to an instruction signal output from the control section 29. Thus, it is possible to feed the band having a desirable length to the side of the object W to be packed. Accordingly, it is not necessary for the worker to lead out the band by hand again. Thus, the large object W to be packed can be banded exactly.

While the embodiment of the present invention has been described above, the present invention is not restricted to the embodiment. In the embodiment, for example, the signal detected by the sensor 25 is input to the counter 26, and furthermore, is supplied to the storage means 27 and is compared through the comparing means, thereby controlling the driving operation of the normal rotating roller 20. The control can be carried out by another means and is not restricted to the embodiment.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A band feed length adjusting device in a packing machine in which a plurality of detecting portions are provided at regular intervals on a side surface of a touch roller which is opposed to a normal rotating roller or a reverse rotating roller and serves to selectively abut on one of the two rollers, thereby constituting band feeding means or band reverse rotating means, and furthermore, a sensor for detecting the detecting portions is provided to face an outer periphery of the touch roller, wherein when an amount of the band led from a band reel through a driving operation of the band feeding means for winding onto an object to be packed is insufficient, the band having a length corresponding to the shortage is led from the band reel through a manual operation and the detecting portions of the touch roller thus moved are detected by the sensor and a result of the detection is supplied to a control section, thereby automatically adjusting a band length required for subsequent band feeding.

* * * * *

UNITED STATES PATENT AND TRADEMARK OFFICE

CERTIFICATE OF CORRECTION

PATENT NO. : 6,609,351 B2
DATED : August 26, 2003
INVENTOR(S) : Tokio Shibazaki et al.

It is certified that error appears in the above-identified patent and that said Letters Patent is hereby corrected as shown below:

Column 5,
Line 3, “machine in which” should read -- machine comprising: --.
Line 5, “portions are provided” should read -- portions provided --.
Line 6, “roller which is” should read -- roller, the touch roller --.
Line 10, “means, and furthermore,” should read -- means; and --.

Column 6,
Lines 1-11, delete the text and insert the following text:

-- wherein when an amount of the band led from a band reel is insufficient, a band length shortage is led from the band reel through a manual operation, the detecting portions of the touch roller detect the band length shortage, a detection signal that correlates to the band length shortage is supplied to a control section, and the detection signal is added to a previously stored band length if the detection signal differs from the previously stored band length, thereby automatically adjusting a new band length required for subsequent band feeding. --

Signed and Sealed this

Twenty-fifth Day of May, 2004

JON W. DUDAS
*Acting Director of the United States Patent and Trademark Office*